United States Patent [19]

Manners-Smith et al.

[11] Patent Number: 4,612,720

[45] Date of Patent: Sep. 23, 1986

[54] LARGE SCALE DISPLAY

[75] Inventors: John Manners-Smith, Northenden; Christopher G. Thompson, Stapeley, both of England; John E. Bailey, Rykkinn, Norway

[73] Assignee: Ferranti PLC, England

[21] Appl. No.: 631,877

[22] Filed: Jul. 18, 1984

[30] Foreign Application Priority Data

Jul. 26, 1983 [GB] United Kingdom ..... 8320169

[51] Int. Cl.[4] ..... G09F 21/16

[52] U.S. Cl. ..... 40/211; 40/450; 40/451; 340/756

[58] Field of Search ..... 40/212, 447, 451, 452, 40/550; 340/756, 789

[56] References Cited

U.S. PATENT DOCUMENTS

| | | | |
|---|---|---|---|
| 1,521,779 | 1/1925 | Martin | 40/212 |
| 1,923,725 | 8/1933 | Haines | 40/212 |
| 2,095,350 | 10/1937 | Soule | 40/212 |
| 3,583,530 | 8/1972 | Robinson | 40/212 |
| 4,236,333 | 12/1980 | Kohm et al. | 40/212 |

OTHER PUBLICATIONS

Mechnix Illustrated–Sep., 1948–pp. 68–69 ("Wonder Bread" advertisement).

*Primary Examiner*—Gene Mancene
*Assistant Examiner*—Wenceslao J. Contreras
*Attorney, Agent, or Firm*—Kerkam, Stowell, Kondracki & Clarke

[57] ABSTRACT

A two dimensional illuminated display for forming on an expansive surface such as an airship envelope comprises (FIG. 3) a set of one dimensional display components 18 each formed by a multiconductor (ribbon) cable 19 having attached thereto by insulation piercing connectors 41 a plurality of display elements 20 containing illumination elements $\mathbf{20}_R$ and $\mathbf{20}_G$ formed by arrays of red and green high intensity l.e.d.'s. The display component cables hang from an attachment point at one end of the cable (21, FIG. 2) and are retained in channels 15, formed on the surface by raised vertically-extending ribs 16, by retaining members 24 extending across the channels by way of through-apertures 25 in the ribs. The retaining members are prevented from withdrawal by similar joining members 26 extending along the ribs. Each illumination element is fed from the cable 19 and the emission axes of the diodes may be tilted relative to the local channel base e.g. by tilting the housing, to align the elements of a display formed on a non-flat surface. The display elements may be other than illuminated and may be non-energizable.

29 Claims, 18 Drawing Figures

LARGE SCALE DISPLAY

Figure 1:
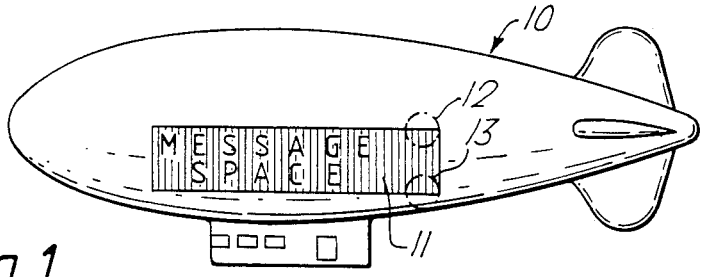

This invention relates to displays and in particular to a relatively large scale display formed by a two-dimensional array of discrete display elements carried by, and formed on, the surface of a structure.

The invention is concerned particularly, but not exclusively, with the provision of an illuminated display on an expansive surface such as that of an airship or building where the dimensions required for distant viewing of the display necessitate a display area of several metres by tens of metres.

It is desirable in such a display, which inevitably consists of a large number of component parts, that these component parts be as similar to each other as possible. Also, it is desirable that the construction be suitable for an exposed atmospheric environment and furthermore, for applications such as the airship mentioned, that the construction be both of little weight and little power consumption.

Clearly different features will assume different levels of importance for different structures and operating environments.

It is an object of the present invention to provide a two-coordinate display on a surface of a structure and a method of forming such a display.

According to a first aspect of the present invention a two dimensional display formed on a surface of a structure comprises a set of channels defined on the surface by pairs of shoulders raised with respect to the channels, the channels each extending along one dimension of the display and the set extending along the second dimension, a plurality of one-dimensional display components each having display elements formed thereon at intervals along its length and located in an individual channel of the set and retaining means operable to retain each of the display components in its channel.

The display may be an illuminted one in which each display component comprises a multiconductor electrical cable and each display element comprises at least one illumination element, attached to appropriate conductors of the electrical cable, and including electrical display driving means operable to supply energising signals to the display components in accordance with the formation of a desired two dimensional display of illumination elements.

According to a second aspect of the present invention a method of forming a two-dimensional display on a surface of a structure comprises forming a plurality of one-dimensional display components each consisting of a plurality of display elements, forming on at least a part of the surface of the structure a plurality of raised ribs extending in pairs defining channels of a set extending along the second dimension, laying the one-dimensional display components in respective channels to form the two dimensional display components of display elements and attaching to the ribs of each channel retaining means extending across the cable at a plurality of points along the channel to keep the display component in the channel.

The method may be applied to forming an illuminated display by forming said display components by attaching display elements, each including at least one illumination element, to multiconductor electrical cable at intervals therealong to make electrical connection with appropriate conductors thereof, and electrically connecting the cables to display element addresing means.

A display in accordance with the present invention is particularly suited to formation on the envelope structure of an airship, such structures enabling a display of say, 25 metres×4 metres to be formed which is readable from a distant viewpoint such as the ground. A similar structure such as a building or other vehicle may require a display of similar or smaller scale, readable from a closer viewpoint, but the basic principles are applicable.

A display formed on an airship may be considered to have to satisfy the greatest number of design constraints and it is with such a structure that embodiments of the invention will be described, by way of example, with reference to the accompanying drawings.

Figure 2A:
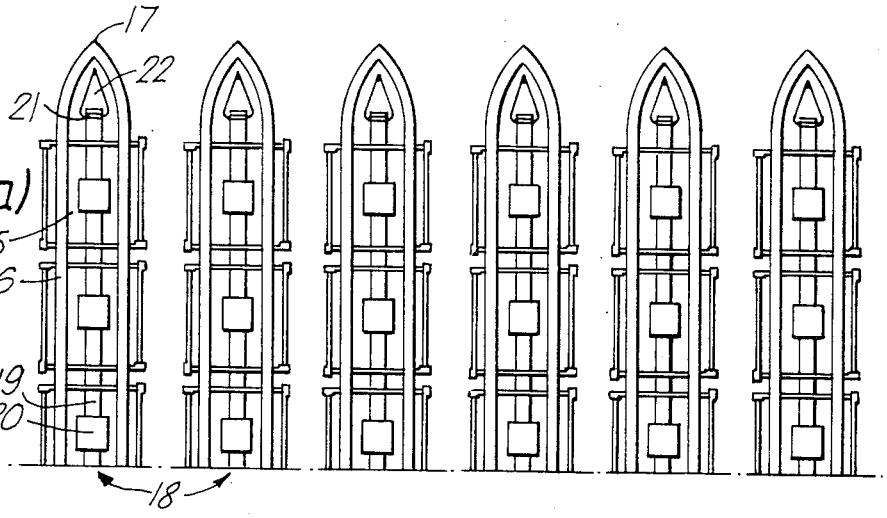
Figure 2B:
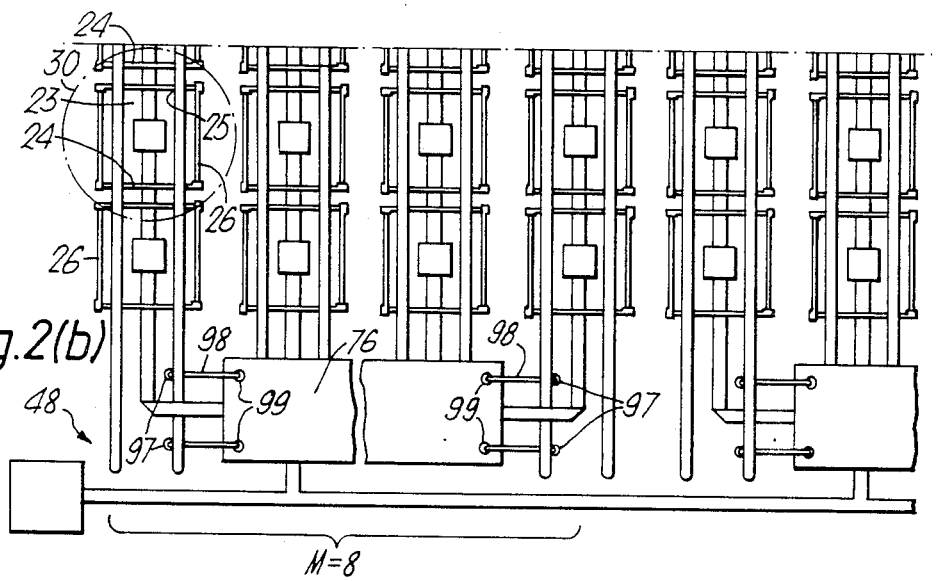
Figure 3:
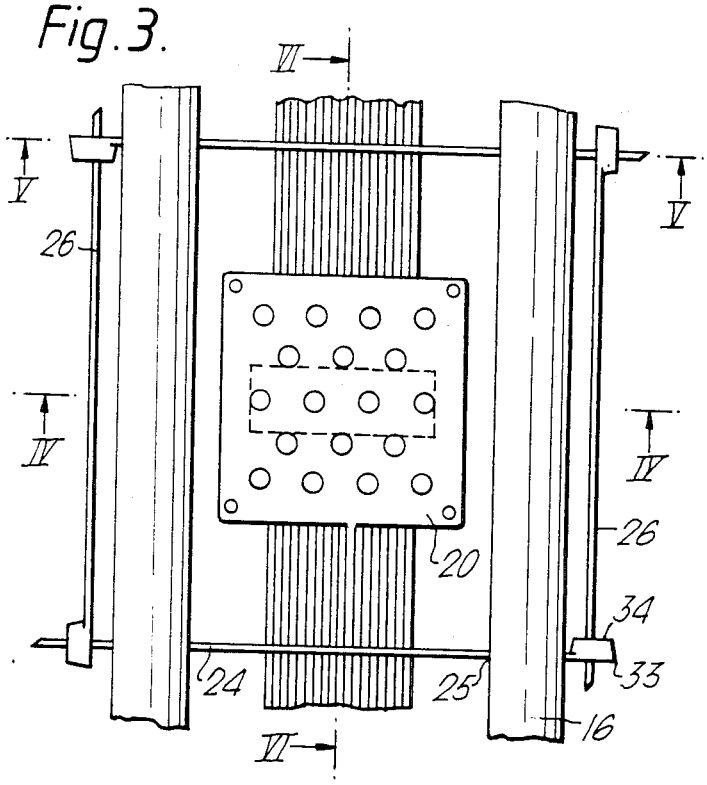
Figure 4:
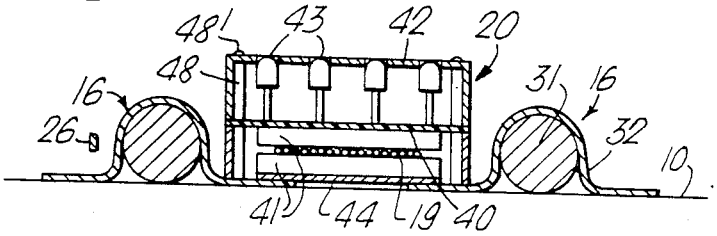
Figure 5:
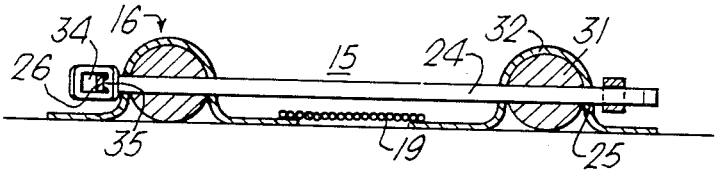
Figure 6:
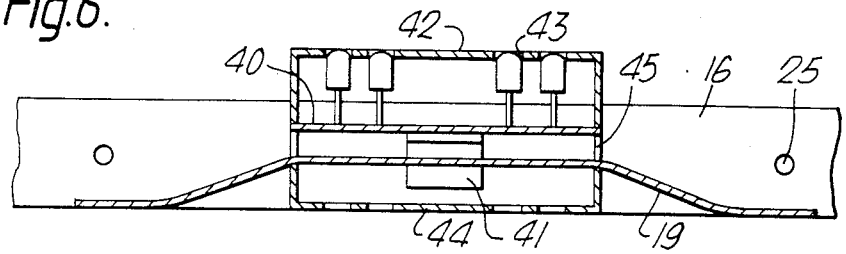
Figure 7:
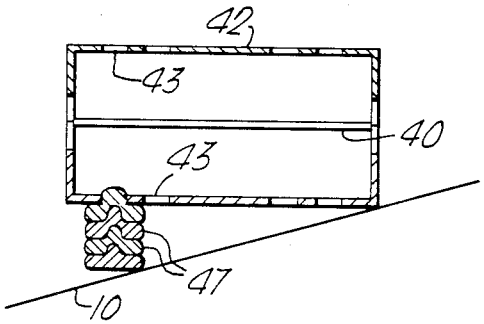
Figure 10:
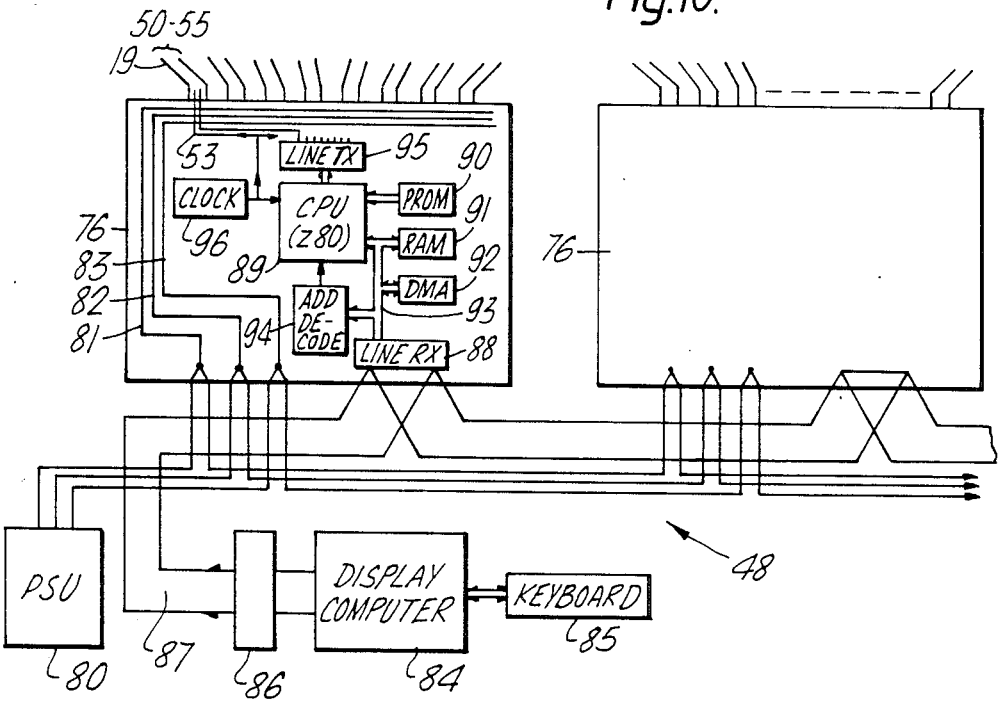
Figure 8:
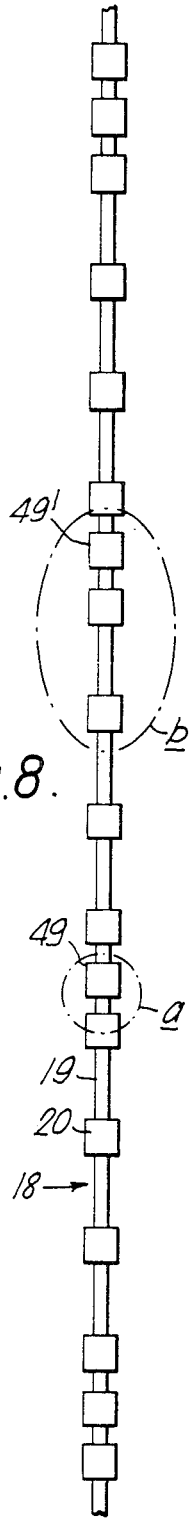
Figure 9B:
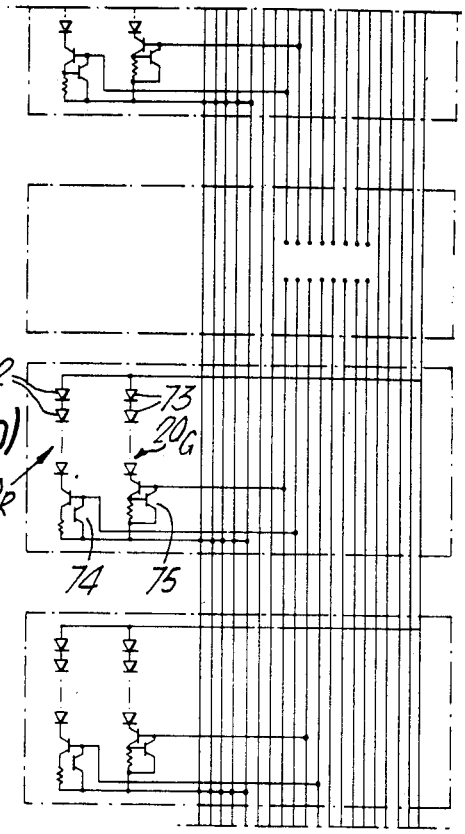
Figure 9A:
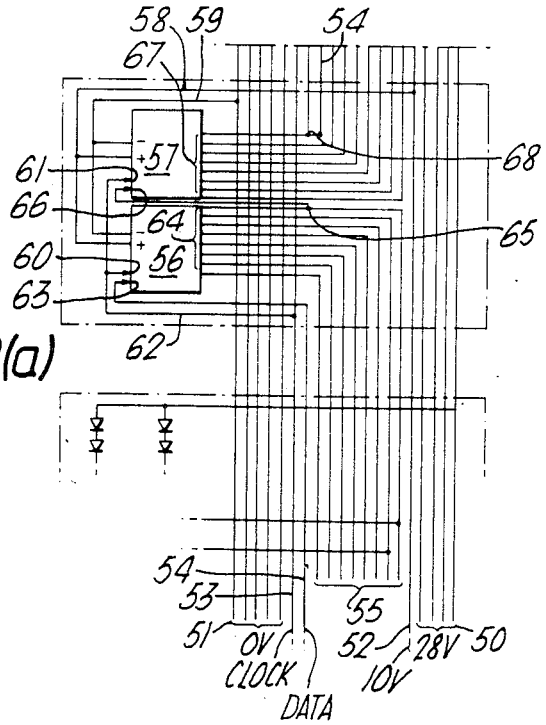
Figure 11A:
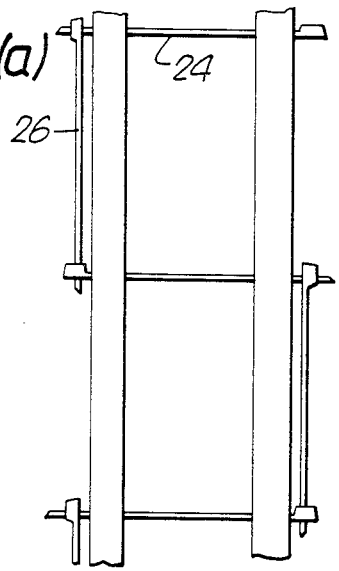
Figure 11B:
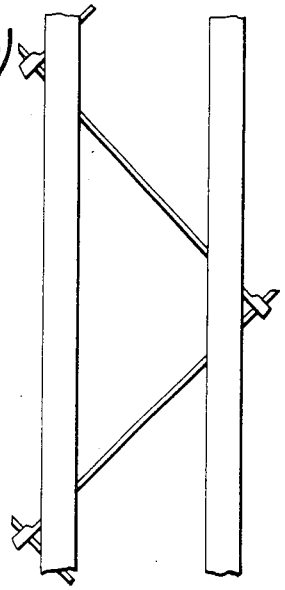
Figure 11C:
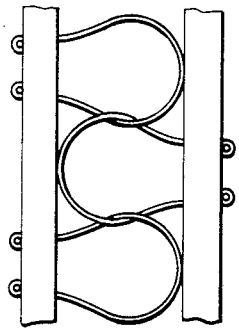
Figure 11D:
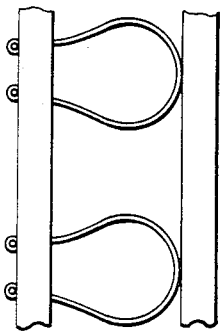
Figure 12A:
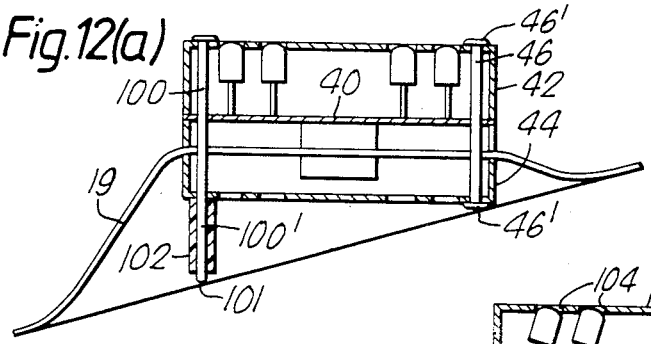
Figure 12B:
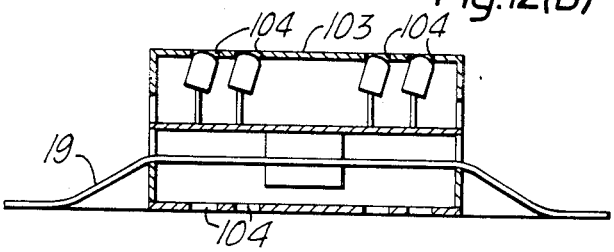

In the accompanying drawings, FIG. 1 is general side view of an airship having an illuminated display formed thereon in accordance with the present invention, FIGS. 2(*a*) and 2(*b*) are enlargements of the encircled portions of FIG. 1 showing in greater detail the construction thereof, FIG. 3 is an enlargement of the ringed portion of FIG. 2(*b*) showing in greater detail cable an illumination element of a display component and retaining means by which it is retained within a channel, FIG. 4 is a sectional elevation through the channel and display component (display element) of FIG. 3 along the line IV—IV, FIG. 5 is a sectional elevation through the channel and display component (cable) of FIG. 3 along the line V—V, FIG. 6 is a sectional elevation along the channel and display component of FIG. 3 taken along the line VI—VI, FIG. 7 is a sectional elevation through an illumination element illustrating a form of assembly for inclining its light emission axis to the base of the channel, FIG. 8 is a detailed view of a portion of one display component, FIGS. 9(*a*) and 9(*b*) are schematic representations of the electrical circuit arrangement of the portions of display component of FIG. 8 shown ringed, FIG. 10 is a block circuit diagram of a portion of the display driving means, FIGS. 11(*a*) to (*d*) are plan views, similar to FIG. 3, but without the display component illustrating alternative configuration of retaining means, and FIGS. 12(*a*) and (*b*) are each a sectional elevation, similar to FIG. 7 showing alternative ways of inclining the light emission axis.

Referring to FIG. 1 a structure such as an airship which has an extensive surface has a display 11 formed thereon.

The display 11 is intended to be read from the ground when the airship is aloft and consequently is of relatively large overall size, say 25 metres long×4 metres high. the display essentially comprises a two-coordinate array of display elements or pixels. In the most general case these are in the form of a rectangular matrix, selected elements being illuminated to provide an alphanumeric or graphical message. Each display element comprises one or more illumination elements, say of different emission colour, enabling the display to vary in colour as well as format.

The display is formed by a set of one dimensional display components and the construction of these and their relationship with the structure is shown by enlarged representation of the circled regions 12 and 13 in FIGS. 2(*a*) and 2(*b*) respectively.

Referring to FIG. 2 the display comprises a set of vertically extending channels 15 each extending vertically down the surface of the envelope.

Each channel is defined by a pair of shoulders formed approximately 5 cms. apart by raised ribs 16 the base of the channel being the external surface of the envelope structure. The set of parallel channels extends horizontally at centres 12–15 cms.

At the upper end of each channel the ribs 16 converge as shown at 17 to divert rainwater flowing down the structure surface around the channels rather than through them. The channels are, however, open and no other effort is made to prevent precipitation entering them.

Within each channel is a display component 18 comprising a continuous multiconductor cable 19, such as a flat ribbon cable, to which are attached at intervals display elements 20. The display component is suspended by the cable 19 which is looped at its upper end 21 and joined to a strap 22 which is itself attached to the structure surface.

The suspension point is the only point by which the display component is attached to the structure but along its length retaining means 23 is provided to retain the component within the channel.

The retaining means comprises a plurality of retaining members 24 which extend across the channel over the cable 19, by way of through-apertures 25 in the ribs, and which are joined to pairs members by joining members 26 which extend along the ribs.

The structure of the display components, retaining means and ribs for the region 30 is shown enlarged in FIG. 3.

Referring to FIGS. 3 and 5 the construction of the ribs and retaining means will be described.

The ribs 16 are each formed by an elongate core 31 of elastomeric material, such as sponge rubber, lying on the surface of the structure 10 covered by a thin strip 32 of flexible material, conveniently the fabric of the envelope, attached to the surface at each side of the core by adhesive. The core is conveniently of circular cross section giving the ribs a rounded profile so that air flowing over the surface 10 transversely to the length of the channel is carried over it without excessive turbulance.

Through-apertures 25 are formed transversely through the ribs, for example by burning away material with a heated probe, and the retaining members 24 extend through both apertures, from the external channel wall of one rib to the external channel wall of the opposing rib.

Each retaining member 24 comprises a flexible plastics ratchet-type cable-tie having formed integrally with one end thereof an enlarged buckle 33 in which is contained a passageway 34 and tongue 35 designed to accept the free end of the tie and its ribbed body which by engagement with the tongue 35 is not removable. The joining members 26 (FIG. 3) are also formed by similar cable ties and the retaining means is formed by engaging the body of one member in the buckle of adjacent member, the retaining and joining members forming a closed square about each display element.

It will be seen that a buckle is disposed adjacent the two outer rib walls of each pair of through-apertures forming an enlarged node between the members preventing the retaining member from withdrawing. Furthermore, it wil be appreciated that should one of the retaining members of any pair break and the parts withdraw through the ribs, the other retaining member will remain intact. The disposition of the through-apertures is such that the retaining member clears the cable intermediate the display elements, while retaining the cable below the tops of the ribs. The cable is thus prevented from being lifted out of the channel by air flow but, because it is attached to the structure at one end only, is able to move in relation to the channel as the channel length varies in accordance with volume changes of the inflated envelope.

Referring again to FIGS. 3, 4 and 6 these show in plan and sectional elevation a display element 20.

Each display element comprising two illumintion elements $\mathbf{20}_R$ and $\mathbf{20}_G$, which emit red and green light independently, is formed by a printed circuit board 40 to the centre of which is soldered part of a stand-off insulation-piercing connector 41 which together with a second part attaches the illumination element 20 to the cable 19 and makes electrical connection to appropriate conductors of the cable. The circuit board 40 also carries the light sources of the illumination elements disposed in rows each side of the connector. The sources of one illumination element $\mathbf{20}_R$ and $\mathbf{20}_G$ each comprise serially connected high intensity light emitting diodes, suitable ones being Stanley Type Nos. SBR 5501 and ESBG 5501 for emitting red light and for emitting green light respectively.

The circuit board and diodes are protected by a cover 42 of moulded thermoplastics material having apertures 43 therein corresponding to the disposition of the diode sources and into which the emitting ends of the diodes project. The cover also supports the diodes against bending of the leads by mechanical shock. Complementing the cover 42 is a base part 44 also formed as a thermoplastics moulding which protects the connector 41 and provides mechanical support therefor against lateral and rotational forces by cable entrance notches 45.

The cover 42 and base part 44 may be formed by the same design of thermoplastics moulding, the apertures in the base and notches in the cove being redundant.

The cover 42 and base 44 may be joined separately to the circuit board 40 and/or to each other. Conveniently the cover and base are joined to each other, sandwiching the circuit board, by fastening pins 46 of thermoplastics material which extend through aligned apertures in the corner of the cover and base and which are heated and deformed to form retaining heads 46'.

One of the problems of employing light emitting diodes as light sources to be viewed at large distances has hitherto been the low level of intensities available. The above described light emitting diodes are constructed with internal optics which produce a relatively intense beam but concentrated to within a viewing angle of about 22°. The cover 42 of each display element serves to hold the diodes so that their optical axes are substantially parallel and directed as required perpendicularly to the circuit board 40.

It will be appreciated that the surface of the structure 10 may not be planar, as in the case of the airship of this example. The display elements at different locations along each channel are caused to be inclined to the base of the channel to such an extent that the optical axes of all the diode light sources from each component are substantially parallel.

This may be achieved by utilising the otherwise redundant apertures 43 in the base portion 44 as shown in the sectional elevation in FIG. 7 by locating therein one or more nestable plastics 'feet' 47.

Referring again to FIG. 2, the one-dimensional display components 18 are connected in groups of M (=8) to display driving 48 means by which operating electrical signals are applied to the cable conductors associated with the illumination elements.

FIG. 8 shows a portion of one display component 18 in greater detail than FIG. 2.

Each display component includes in addition to the display elements shown in FIG. 2 shift register means comprising a plurality of shift register-carrying boards 49 and isolator boards 49' distributed at intervals along the cable.

The multiconductor cable 19 is conveniently formed by a flat ribbon cable to which are connected at regularly spaced intervals display elements 20. Between each set of four successive display elements (that is, eight illumination elements) is a board of the distributed shift register means, the boards 49 and 49' being disposed alternately.

The cable 19, ringed portion a, comprising a shift register board 49, and the ringed portion b, comprising an isolator board 49' and two display elements 20, are shown in greater electrical detail in FIGS. 9(*a*) and 9(*b*) respectively.

The ribbon cable 19 requires thirteen separate conductors but to enable the supply of adequate current to the illumination elements while retaining minimal cable parameters a twenty-conductor cable is employed, four of said conductors comprising a 28 volt supply rail 50 and five of the conductors comprising a 0 volt return rail 51. Of the other conductors, one 52 comprises a 10 volt supply rail for the shift register boards 49, 53 carries clocking pulses to all the shift registers, 54 carries energising data from one shift register to the next and the eight conductors 55 connect the shift register outputs to the energising inputs of associated display elements.

Referring to FIG. 9(*a*) a shift register board 49 contains two eight-bit shift registers 56 and 57 each connected by lines 58, 59 to power rails 52 and 51 and with clock inputs 60, 61 connected by line 62 to clock rail 53.

Shift register 56 has a serial input terminal 63 to which the data line 54 is connected and eight stage outputs shown at 64 to which are connected the eight conductors 55 extending downwardly of the board as shown in the Figure. The highest stage output is connected at 65 to a serial input terminal 66 of the register 57. The register 57 also has eight stage outputs shown at 67 to which are connected the eight conductors 55 extending upwardly of the board as shown in the Figure. The highest stage output is connected at 68 to a continuation of the serial energising data line 54 extending to the next shift register board.

Considering the eight outputs from shift register 57 the conductors 55 extend along the cable beyond four display elements (eight illumination elements) and are shown in Figure 9(*b*) terminating at an isolator board 49'. The same conductor group, electrically isolated, extends from the next (higher) shift register (not shown) down to the isolator board, also serving eight illumination elements. The other conductors 50–54 continue unbroken through the isolator but may, for manufacturing reasons, form junctions between separate cable lengths.

The display elements 20, as stated above, each comprise two illumination elements $20_R$, $20_G$ formed each by a serially connected string of high intensity light emitting diodes (72, 73) and an energising switch 74, 75 respectively connected between the power rails 50 and 51. The illumination elements are arranged to operate independently in accordance with energisation of the switch and to emit red or green light, or any combination thereof.

For each display element, power supply connection is made by tapping the power rails 50 and 51 and the energising signals to the switches 74 and 75 are obtained by tapping the conductor group 55.

As stated above each section of conductors 55 is associated with eight illumination elements and the conductors are tapped by the element energising switches such that the switches disposed along the display component are energised in turn by successive stages of the shift register means.

The cables 19 of the diplay components of each group of eight (=M) are connected to a drive buffer 76 associated with the display driving means 48 and shown in greater detail in FIG. 10.

The display driving means 48 comprises a power source 80 having 0v, 10v and 28v outputs each connected to one of three power buses 81, 82, 83 in the drive buffer 76.

The display format is determined within a suitably programmed microcomputer 84 from data inputs from an alphanumeric keyboard or graphical tablet indicated at 85. A detailed description of the functioning of the computer and the program by which it operates, which will vary in detail in accordance with the computer used, are not necessary to an understanding of the invention and will not be given but are required to produce for each drive buffer a buffer identification code followed by a block of data in the form of a stream of 8-bit words, the number of words being equal to the number of elements of a display component. The buffer identification codes and data are transmitted in sequence for the number of drive buffers in the display and may be repeated cyclically or only when the display is to be changed, such as when new information is input.

The driving data is carried by way of an interface 86 on an interconnecting bus 87 which connects to each drive buffer 76 at a line receiver 88.

Each drive buffer comprises an 8-bit microprocessor CPU 89, such as a Zilog Z80 with a PROM 90 containing the operating instructions by which the buffer functions, a RAM 91 which comprises working memory for the CPU and storage area for the display defining words received from the computer 84 and a DMA controller 92 by which said words are loaded into the memory. An address/data bus 93 connects the line receiver 88 to the CPU and its peripheral devices and also to a decoder 94 which reponds to the identification code prefacing each block of data designating that buffer to interrupt the CPU and load the data into the RAM store.

The CPU also has an output data bus connected to a line transmitter 95 having eight outputs (one per bit of each 8-bit word from the CPU) and a clock 96 timing operation of the CPU.

The multiconductor cable 19 described in relation to FIG. 9(*a*) with its conductors (or conductor group) 50–55 is connected to the drive buffer with the power conductors 50, 51 and 52 connected to the power buses 83, 81 and 82 respectively the clock line 53 connected to an output of clock 96 and the shift data line 54 connected to one output terminal of the transmitter 85. The other seven cables of adjacent display components are similarly connected, the only points of difference being the connection of the respective shift data lines to different outputs of the line transmitter 95. The conductor group 55 of each cable is merely anchored to the buffer board without electrical connection.

To produce a display the drive computer 84 sends blocks of words to each drive buffer in turn at high speed, which thereafter drive each group of display components in parallel. Each drive buffer reads the words from the RAM one at a time and applies one bit of each to corresponding data line 54 by way of the line transmitter 95. The words are read at a rate governed by clock 96 which also clocks the shift register means of the display components to shift the bits along the display component, addressing the energising switch 74 or 75 of each illumination element in turn until the number of words corresponding to the number of illumination elements have been read and shifted.

Clearly after each shift an energisation signal is produced by a shift register output and some of the illumination elements are energised but to avoid emission of light the clocking rate is of sufficiently high rate that no visible display appears until the clocking is ended, at which time those illuminated elements energised comprise the display. Furthermore the display remains without refresh until it is desired to change the display.

It will be appreciated that if desired the information can be shifted along the display components at a slower rate becoming visible at each stage and appearing as a travelling message.

The display drive controlling means 48 is mounted conveniently in the airship gondola with the source of power for the illumination elements, and the drive buffers 76 are assembled on circuit boards mounted on the surface of the structure by utilising the channel ribs 16 and retaining and joining members similar to 25 and 26. It may be seen from FIG. 1 that for each group of eight display components, the channels associated with two are slightly shorter, enabling the buffer board to be located adjacent the structure surface and between the ribs of the adjacent two channels. One (or both) of the ribs of each said adjacent channel has through-apertures 97 through which retaining members 98 pass, extending by way of apertures 99 in the board to be looped through and joined to each other.

It will be appreciated that there are alternative procedures for achieving many of the functions described and a number of different materials which may be used, some being a matter of choice, others constrained by the structure or its operating environment.

The ribs, for example, when formed on the surface of a structure like an airship envelope need to be flexible and expansible to accommodate changes in the dimensions of the surface with pressure. The flexible outer layer of the ribs is conveniently the same material as the structures surface but may be of any other material having the desired properties. Similarly, the core may be formed of a different suitably extensible material. The sectional profile of the ribs is also open to modification, bearing in mind the importance of air flow across the surface in some applications.

The retaining and joining members are formed in pairs. If desired the retaining member of each pair may be joined to each other and adjacent pairs by single joining members in serpentine manner as shown in FIG. 11(*a*) Variations on this may be employed as exemplified in FIGS. 11(*b*) to 11(*d*). FIG. 11(*a*) shows an arrangement in which a string of cable ties extend diagonally of the channels in serpentine manner, each of the ties being a retaining member that crosses the channel.

FIG. 11(*b*) shows retaining members each with its ends having enlarged terminations and threaded (before terminating) by way of through apertures in the same ribs. Retaining members associated with those of the opposite ribs may interlink.

FIG. 11(*c*) shows an arrangement of retaining means in which the retaining members all pass by way of apertures in one rib wall and have enlarged terminations. The retaining members are flexible in one plane only and are resistant to bending out of the plane of the loop (the plane of the drawing) thus retaining the cable in the board.

Clearly, many other types of device can be used for retaining the cable in the channel with and without the use of apertures in the ribs, e.g. a retaining member could be clipped with compressive clips onto the ribs at each side of the cable.

As an alternative to attaching the cables 19 to the structure by means of straps 22, the terminating loop of cable may be formed around an end one of the retaining members crossing the channel, providing of course that the retaining member and/or rib can support the strain of the display component.

The arrangement shown in FIG. 7 for inclining an illumination element to the base of its channel may also be varied in a number of ways.

For instance the cover and base mouldings 42, 44 may be formed wedge-shaped (not shown) so that the circuit board 40 is inclined to the base of the channel. However a large number of different base mouldings is then required to cater for surface curvature.

A alternative method makes use of the fastening pins 46 and is shown in the sectional elevation of a display element FIG. 12(*a*). The element is similar to that shown in FIGS. 4 and 6 and like parts are given the same reference numerals. In this arrangement two of the corner fastening pins 46 are as described above. The fastening pins for the other corners are formed by a single rod bent into a U-shape with the arms thereof forming fastening pins 100 and the bight 101 bearing against the base of the channel. The arm portion 100' external to the base 44, and optionally the bight portions, are provided with sleeving 102 of greater diameter than the pin apertures in the base 44 to form spacers and the ends of the arms are heated and flattened to fasten the core and base together, one end of the circuit board being inclined to the base of the channel to an extent determined by the length of the sleeved arm portion 100'.

It will be appreciated that all of the illumination elements may be made from standard parts and different inclinations readily defined by altering the lengths of the sleeved arm portions. Another alternative is shown in sectional elevation in FIG. 12(*b*) and base, and the cover 103 differing from the cove 42 of FIGS. 3, 5 and 6 in that the apertures 104 (corresponding to 43 in FIG. 3) are displaced with respect to the positions of the diodes on the circuit board. The light emitting diodes are inclined to the circuit board 40 to project through the apertures 104 thereby inclining their optical axes to the board and the base of the channel.

The display is not restricted to a construction in which the display components extend vertically of the structure. If desired, the channels may be formed extending horizontally, or even diagonally.

Furthermore, the display is not limited to a regular array of illumination elements some of which are addressed, i.e. energised, to provide any display message. It it is desired to display a fixed message or graphic display then the display components need only be provided at the locations and carry illumination elements only at the relevant positions thereon to form that display.

It will also be appreciated that a display as described is not limited to use in the dimensions given and with an airship structure.

Such a display may be formed for the surface of, say, a building, either an inflated building relying upon internal air pressure or a more conventional building, and may be formed with dimensions of the elements in keeping with the overall display size.

In an arrangement in which the structure permits the channels may for instance be formed recessed within the general surface, the shoulders bounding the channels not then taking the form ribs and favouring a form of retaining means in which retaining members clip into or otherwise cap the channels.

All embodiments of the invention described above have been in relation to an illuminated display in which the display elements are light emitting and mounted on, and energised by, a multiconductor cable. It will be appreciated that the display elements may take an energisable form other than illumination sources, e.g. mechanically or electrically shuttered or repositioned reflectors. Alternatively the display elements may take a non-energisable form e.g. different coloured sections of a linear display component tape comprising said display elements; such a display is then only able to change by replacing the display component or by attaching a different display element thereto.

We claim:

1. A two dimensional display formed on a surface of a structure comprising a set of channels defined on the surface by pairs of shoulders raised with respect to the channels, the channels each extending along one dimension of the display and the set extending along the second dimension, a plurality of one-dimensional display components each comprising a multiconductor electrical cable having elements, each comprising at least one illumination element, attached to appropriate conductors thereof at intervals along its length and located in an individual channel of the set, retaining means comprising for each channel a plurality of retaining members held by said shoulders at a plurality of points along the channel length and extending across the display components operable to retain each of the display means operable to supply energising signals to the display components in accordance with the formation of a desired two-dimensional display of illumination elements.

2. A display as claimed in claim 1 in which the multiconductor electrical cable is a flat ribbon cable to appropriate conductors of which the display elements are connected to provide electrical supply and mechanical support.

3. A display as claimed in claim 2 in which each illumination element comprises an array of high intensity light sources.

4. A display as claimed in claim 3 in which the array comprises light sources of at least two different types able to emit light of different colours.

5. A display as claimed in claim 4 in which the different types of light sources are able to emit light of red and green colour.

6. A display device as claimed in claim 4 in which in each display element the illumination element light sources are mounted on a circuit board and supported with their optical emission axes perpendicular thereto by a cover into which the sources project.

7. A display as claimed in claim 6 in which the cover is attached to a base part enclosing therebetween the source-carrying circuit board, the conductor and that a portion of cable adjacent the connector and coextensive with the circuit board, the base part bearing against the structure surface in the channel.

8. A display as claimed in claim 7 in which the base part is shaped such that the common optical emission axis of the light sources is inclined to the perpendicular to the local channel base.

9. A display as claimed in claim 7 in which one or more projections from the base part bear against the channel base to incline the common optical emission axis of the sources to the perpendicular thereto.

10. A display as claimed in claim 9 in which each projection comprises a pin joining the cover and base parts of the illumination element.

11. A display as claimed in claim 7 formed on the surface of a structure curving in at least one plane, the display elements of each display component being inclined to the channel base such that the optical emission axes of the illumination elements of the two dimensional display are substantially parallel.

12. A display as claimed in claim 5 in which the light sources are high intensity light emitting diodes.

13. A display as claimed in claim 12 in which the light emitting diodes are Stanley types SBR 5501 and ESBG 5501 respectively.

14. A display as claimed in claim 1 in which the channels extend substantially vertically and each of the display components is attached by one end of the cable thereof to the structure and is suspended thereby.

15. A two dimensional display formed on a surface of a structure comprising a set of channels, defined on the surface by pairs of shoulders formed by ribs raised above the structure surface the channels, each extending along one dimension of the display and the set extending along the second dimension, a plurality of one-dimensional display components each having display elements formed thereon at intervals along its length and located in an individual channel of the set and retaining means, operable to retain each of the display components in its channel, comprising for each channel a plurality of retaining members held by the ribs at a plurality of points along the channel length and extending across the display component.

16. A display as claimed in claim 15 in which at least one of the retaining members extends into the channel by way of a through-aperture in a rib from an outer channel wall and emerges outside of the channel wall by way of a different through-aperture.

17. A display as claimed in claim 16 in which for each said retaining member the through-apertures are in opposing ribs.

18. A display as claimed in claim 17 in which the retaining members, extending by way of aid through apertures, are joined to adjacent retaining members by joining members extending along an outer wall of a rib.

19. A display as claimed in claim 18 in which each joint between a retaining and joining member lies adjacent one of said through-apertures preventing withdrawl of the retaining member from the channel.

20. A display as claimed in claim 19 in which each of said retaining and joining members has a buckle end of greater section than the through-apertures and a free end able to be passed through said different apertures to engage the buckle of a cooperating member.

21. A display as claimed in claim 20 in which the retaining members are coupled in pairs one each side of a display element each retaining member being joined to the adjacent retaining member of the pair by a pair of joining members each on opposite sides of the channel.

22. A display as claimed in claim 20 in which the retaining members and joining members extend along each channel in a serpentine manner, with each retaining member being joined to an adjacent retaining member by a single joining member, adjacent joining members being on opposite sides of the channel.

23. A display as claimed in claim 18 in which the retaining members and joining members comprise ratchet-type cable ties.

24. A display as claimed in claim 15 in which the channels extend substantially vertically and each of the display components is attached by one end thereof to the structure and is suspended thereby, the ribs at the upper end of each channel converging beyond the attached end of the display component.

25. A display as claimed in claim 15 in which the ribs have a sectional profile providing at least a partially streamlined air flow across the structure surface and the channels.

26. A display as claimed in claim 15 in which each rib comprises an elongate core abutting the surface structure and covered by a thin strip of flexible material attached to the surface of the sructure at each side of the core.

27. A display as claimed in claim 26 in which the core is formed of a solid elastomeric material.

28. A display as claimed in claim 27 in which the strip of flexible material is attached to the surface of the structure by adhesive.

29. A display as claimed in any one of the claims 25 to 28 formed on the surface of an inflated structure, the retaining means permitting relative movement between the display components and the channel allowing for changes in the channel dimensions with changes of structure internal pressure.

* * * * *

UNITED STATES PATENT AND TRADEMARK OFFICE

CERTIFICATE OF CORRECTION

PATENT NO. :4,612,720

DATED :September 23, 1986

INVENTOR(S) :John Manners-Smith; Cristopher Garth Thompson; John-Edward Bailey

It is certified that error appears in the above-identified patent and that said Letters Patent is hereby corrected as shown below:

Column 9, line 53, after "display" insert -- components in its channel and electrical display driving --.

Signed and Sealed this

Twenty-fourth Day of November, 1987

*Attest:*

DONALD J. QUIGG

*Attesting Officer*

*Commissioner of Patents and Trademarks*